US007585348B2

(12) United States Patent
Nyberg et al.

(10) Patent No.: US 7,585,348 B2
(45) Date of Patent: Sep. 8, 2009

(54) FEEDSTOCK COMPOSITION FOR POWDER METALLURGY FORMING OF REACTIVE METALS

(75) Inventors: Eric A. Nyberg, Kennewick, WA (US); Kenneth Scott Weil, Richland, WA (US); Kevin L. Simmons, Kennewick, WA (US)

(73) Assignee: Battelle Memorial Institute, Richland, WA (US)

( * ) Notice: Subject to any disclaimer, the term of this patent is extended or adjusted under 35 U.S.C. 154(b) by 340 days.

(21) Appl. No.: 11/601,090

(22) Filed: Nov. 17, 2006

(65) Prior Publication Data

US 2007/0068340 A1 Mar. 29, 2007

Related U.S. Application Data

(62) Division of application No. 10/796,424, filed on Mar. 8, 2004, now abandoned.

(51) Int. Cl.
*B22F 1/00* (2006.01)

(52) U.S. Cl. ..... 75/252

(58) Field of Classification Search ..... 75/252
See application file for complete search history.

(56) References Cited

U.S. PATENT DOCUMENTS

| | | | | |
|---|---|---|---|---|
| 3,330,892 | A | 7/1967 | Herrmann | |
| 3,765,954 | A * | 10/1973 | Tokuda et al. | 148/220 |
| 3,769,044 | A | 10/1973 | Horton | |
| 4,113,480 | A | 9/1978 | Rivers | |
| 4,765,950 | A | 8/1988 | Johnson | |
| 4,867,943 | A | 9/1989 | Kiyota | |
| 4,894,088 | A | 1/1990 | Yamaguchi et al. | |
| 4,964,907 | A | 10/1990 | Kiyota et al. | |
| 5,064,463 | A | 11/1991 | Ciomek | |
| 5,258,155 | A | 11/1993 | Sekido et al. | |
| 5,441,695 | A | 8/1995 | Gladden et al. | |
| 5,854,379 | A | 12/1998 | Takayama et al. | |
| 6,075,083 | A | 6/2000 | Peiris | |
| 6,315,935 | B1 | 11/2001 | Schoonover et al. | |
| 6,350,328 | B1 | 2/2002 | Hostetler | |
| 6,376,585 | B1 | 4/2002 | Schofalvi | |
| 2002/0057980 | A1 | 5/2002 | Morita et al. | |
| 2003/0091456 | A1 | 5/2003 | Bloemacher et al. | |
| 2003/0220424 | A1 | 11/2003 | Schofalvi et al. | |
| 2005/0196312 | A1 | 9/2005 | Nyberg et al. | |

FOREIGN PATENT DOCUMENTS

| | | |
|---|---|---|
| JP | 04-116104 | 4/1992 |
| JP | 06-002011 | 1/1994 |

OTHER PUBLICATIONS

XP009048747, May 1990, Chung et al.
Nyberg, et al., U.S. Appl. No. 11/601,421, filed Nov. 17, 2006, Method of Using a Feedstock Composition for Powder Metallurgy Forming of Reactive Metals.
PCT International Preliminary Report/Written Opinion, PCT/US2005/007178, Sept. 21, 2006.
McGarry, Kevina, et al; "Decomposition and combustion of EVA and LDPE alone and when fire retarded with ATH", Polymer International, 2000, 1193-1198 pps., Centre for Materials Research, University of Salford, Salford M5 4WT, UK.
http://dissertations.ub.rug.nl/FILES/faculties/science/1997/g.bosscher/c5.pdf, "Thermal Behavior of the Inorganic-Organic Polymers", Chapter 5, 1997, 81-101 pps.

* cited by examiner

*Primary Examiner*—Roy King
*Assistant Examiner*—Ngoclan T Mai
(74) *Attorney, Agent, or Firm*—Allan C. Tuan

(57) ABSTRACT

A feedstock composition and a method of forming metal articles using powder metallurgy techniques comprise mixing metal powders and a novel aromatic binder system. The composition of the novel feedstock comprises an aromatic binder system and a metal powder. The aromatic binder system comprises an aromatic species and can further comprise lubricants, surfactants, and polymers as additives. The metal powder comprises elemental metals, metal compounds, and metal alloys, particularly for highly-reactive metals. The method of forming metal articles comprises the steps of providing and mixing the metal powder and the aromatic binder system to produce a novel feedstock. The method further comprises processing the novel feedstock into a metal article using a powder metallurgy forming technique. Metal articles formed using the present invention have an increase in carbon and oxygen contents each less than or equal to 0.2 wt % relative to the metal powder used to fabricate the article.

21 Claims, 2 Drawing Sheets

FEEDSTOCK COMPOSITION FOR POWDER METALLURGY FORMING OF REACTIVE METALS

REFERENCE TO RELATED APPLICATIONS

This application is a division of application Ser. No. 10/796,424, filed on Mar. 8, 2004, now abandoned which is hereby incorporated by reference in its entirety.

FIELD OF THE INVENTION

The present invention generally relates to metal forming techniques, and more particularly to the field of powder metallurgy forming techniques for reactive metals and articles made therefrom.

BACKGROUND

Powder metallurgy comprises the use of metal powders to form high-integrity, often fully-dense metal articles. It encompasses a number of very diverse metal fabrication techniques for the economical production of complex, near-net-shape articles. Examples of powder metallurgy fabrication techniques include extrusion, injection molding, compression molding, powder rolling, blow molding, laser forming, isostatic pressing, and spray forming. Powder metallurgy fabrication techniques offer several desirable features including the ability to easily produce graded structures, impregnate porous preforms, fabricate a dispersion of second phase particles in a parent matrix, and produce non-equilibrium phases and structures. While a number of materials can be formed using powder metallurgy techniques, highly-reactive metals are incompatible with current processing practices. Processing the reactive metals according to the powder metallurgy techniques known in the art typically results in metal articles containing unacceptably-high impurity concentrations. The presence of these impurities, particularly carbon, oxygen, and nitrogen, severely degrades the mechanical properties of the resultant articles. While alternative forming methods such as machining and casting exist, in many instances the alternatives are prohibitively expensive or produce components with unacceptable material properties. Therefore, the alternative forming methods have little value outside of niche markets.

Current titanium metal injection molding (MIM) practices provide excellent examples of powder metallurgy limitations. Titanium exhibits an amazing combination of properties; it is extremely lightweight, exceptionally resistant to corrosion, very strong and stiff, and resistant to creep and fatigue. Most powder metallurgy techniques, including MIM, involve mixing a metal powder with a primarily-polymeric or -aqueous binder, forming the shape of the metal article, heating to remove the binder, and then sintering at high temperature. However, titanium readily reacts with oxygen, carbon, and nitrogen at elevated temperatures, i.e. during binder burn-out and sintering, and loses many of its desirable properties. Consequently, titanium is generally incompatible with current MIM processes in applications calling for the mechanical properties of the contaminant-free metal.

Development of a binder system that is compatible with reactive metals appears to be the key technical barrier to making powder metallurgy techniques widely applicable and valuable across a broad range of materials and markets. Thus, a need for both a binder system and a method of forming metal articles exists for powder metallurgy of highly-reactive metals and metal alloys.

SUMMARY

In view of the foregoing and other problems, disadvantages, and limitations of powder metallurgy techniques for highly-reactive metals, the present invention has been devised. The invention resides in a novel composition of a feedstock for powder metallurgy forming techniques and a method of forming metal articles. The composition of the novel feedstock comprises an aromatic binder system and a metal powder.

The method of forming metal articles comprises the steps of providing a metal powder and an aromatic binder system and mixing the metal powder and the aromatic binder system to produce a novel feedstock. The method further comprises processing the novel feedstock into a metal article using a powder metallurgy forming technique.

It is an object of the present invention to provide a feedstock for powder metallurgy forming techniques that results in metal articles having little or no increase in impurities compared to the metal powder starting material.

It is another object of the present invention to expand the applicability of powder metallurgy forming techniques to more metals, especially those that are highly reactive.

It is a further object to provide a method of forming metal articles having little or no increase in impurities compared to the metal powder starting material.

It is a still further object of the present invention to provide metal-injection-molded Ti articles having an increased carbon and oxygen content each less than 0.2% relative to a Ti powder from which the article is processed.

DETAILED DESCRIPTION

Figure 1:
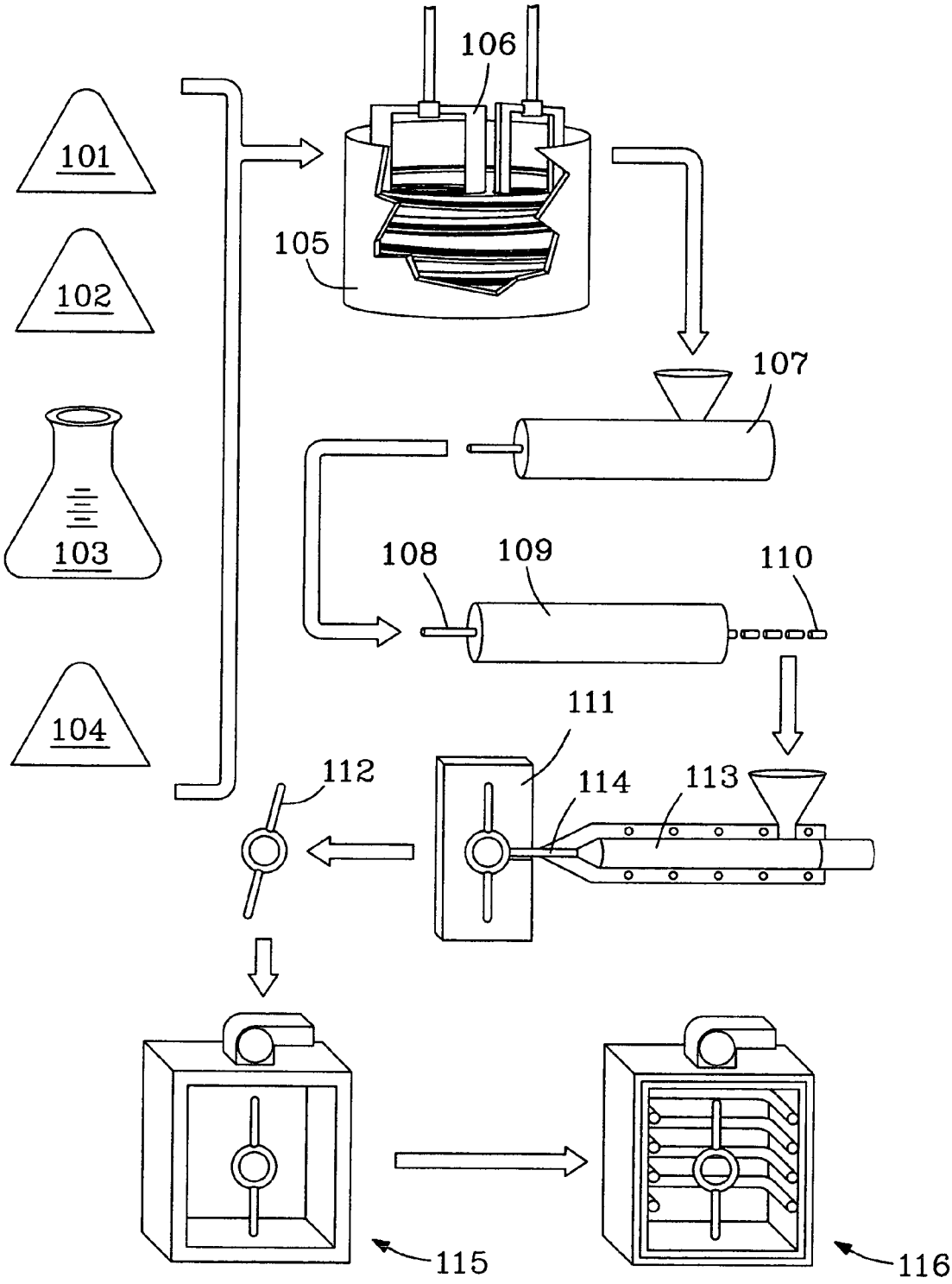
FIG. 1 is a schematic of one embodiment of the method of forming.

The present invention is directed to a composition of a feedstock for powder metallurgy techniques and a method of forming metal articles. The metal articles have a very high purity, even when composed of reactive metals, because the feedstock utilizes a binder system that is easily removed, does not require burn-out in oxidizing environments, and leaves behind little to no carbon and/or nitrogen in the articles. The binder offers relatively high green- and brown-part strength, rapid sublimation under moderate vacuum and/or elevated temperature, and even serves simultaneously as a solvent for supplementary binder phases such as thermoplastic and/or thermoset polymers, lubricants, and/or surfactants.

The invention encompasses a feedstock comprising an aromatic binder system and a metal powder. The aromatic binder system comprises at least one aromatic species and can optionally comprise polymers, lubricants, and/or surfactants. As used herein, metal powder refers to an elemental metal, as well as its compounds and alloys, in a finely-divided solid state. Furthermore, the term aromatic refers to the class of cyclic, organic compounds satisfying Huckel's criteria for aromaticity. The present invention contemplates mixing the aromatic binder system and the metal powder to form the feedstock, which is then used in powder metallurgy forming techniques.

At present, commonly used binders include water, which oxidizes the metal during heating, or difficult-to-remove organics such as waxes and oils. In contrast, the present invention uses aromatic species as the major binder component in the feedstock. The aromatic species can be monocyclic or polycyclic and can include benzene, naphthalene, anthracene, pyrene, phenanthrenequinone, and combinations thereof; though the list of suitable aromatics is not limited to these materials. While the aromatic species can comprise less than approximately 40% of the volume of the feedstock, in one embodiment, it comprises between approximately 29% and 37%. Preferably, the feedstock contains as little of the aromatic species as necessary to maintain the integrity of the green and brown parts.

While the present invention is especially advantageous to forming reactive metal articles, one skilled in the art will appreciate that it is applicable to almost any metal article. In one embodiment, the metal powder comprises elemental metals selected from the group of refractory metals, metals commonly used for gettering, alkaline earth metals, and group IV metals, as well as compounds and alloys of the same. Examples of refractory metals include, but are not limited to Mo, W, Ta, Rh, and Nb. Getter materials are those that readily collect free gases by adsorption, absorption, and/or occlusion and commonly include Al, Mg, Th, Ti, U, Ba, Ta, Nb, Zr, and P, though several others also exist. Finally, the group 4 metals include Ti, Zr, and Hf. Examples of metal compounds include metal hydrides, such as $TiH_2$, and intermetallics, such as TiAl and $TiAl_3$. A specific instance of an alloy includes Ti-6Al,4V, among others. The $TiH_2$ powder appears to promote higher densities at relatively lower sintering temperatures. Furthermore, $TiH_2$ appears to result in the incorporation of fewer impurities presumably because the hydrogen reacts with contaminants to form volatile organics that can be easily removed with heat. In another embodiment, the metal powder comprises at least approximately 45% of the volume of the feedstock, while in still another, it comprises between approximately 54.6% and 70.0%.

In one embodiment, the aromatic binder system further comprises a polymer, which may be up to approximately 10% of the volume of the feedstock. The polymer may be a thermoplastic, a thermoset, or a combination of both. Suitable thermoplastics enhance the strength of the green and brown bodies and include, but are not limited to ethylene vinyl acetate (EVA), polyethylene, and butadiene-based polymers. Thermosets such as polymethylmethacrylates, epoxies, and unsaturated polyesters, among others, ultimately help hold the article together after removal of the aromatic binder. The thermoplastic can range between approximately 2.1% and 5.3% of the volume of the feedstock. The thermoset can be approximately 2.3% of the volume of the feedstock. Preferably, the polymer comprises a mixture of the thermoplastic and the thermoset, wherein the thermoplastic comprises 2.1%-5.3% of the feedstock volume and the thermoset comprises 2.3% of the feedstock volume.

In another embodiment, the aromatic binder system further comprises a surfactant. The surfactant reduces instances of agglomeration in the feedstock and allows for higher metal powder loadings. Surfonic N-100® is a nonionic surfactant obtained from Huntsman Corporation (Port Neches, Tex.) and has been effective, though one skilled in the art could identify suitable alternatives. The surfactant can comprise up to approximately 3% of the volume of the feedstock, and preferably comprises approximately 2.3% of the feedstock volume.

In another version of the present invention, the aromatic binder system further comprises a lubricant. Examples of lubricants comprise organic, fatty acids and solid waxes, including microcrystalline waxes, among others. The organic, fatty acids include stearic acid as well as the metallic salts and the branched or substituted versions of the same. Instances of solid waxes include the paraffin waxes and carnuba wax. Addition of the lubricant to the feedstock composition improves the homogeneity within the powder compact and the flow into the mold and eases release of the part from the mold. The lubricant can comprise up to approximately 3% of the feedstock volume, and preferably comprises approximately 1.5%.

In another embodiment, the metal powder may further comprise an alloying powder. An exemplary alloying powder comprises a sintering aid. A sintering aid such as silver can reduce the temperature required for effective sintering of the brown state that results in the final article. The present invention also contemplates the use of alloying powders as a unique way of forming metal alloy and metal matrix composite material articles that are otherwise unattainable through conventional metal forming processes. Conventional processes such as melt alloying can often result in inhomogeneous products due to segregation of the constituent metals based on their different melting points. Mixing the metal elements as powders in the feedstock, i.e. a metal powder and an alloying powder, provides a solid-state approach for fabricating alloys from metal alloys and metal matrix composite materials and for potentially minimizing inhomogeneities in those articles. An example of a metal matrix composite material includes a Ti—$TiB_2$ composite.

Table 1 provides a summary of one embodiment of the novel feedstock composition. It also shows an example of a Ti-based feedstock composition that has successfully been formed into a metal article.

TABLE 1

Summary of one embodiment of the novel feedstock composition. Also summarized is a sample composition for a Ti-based feedstock.

| Feedstock Component | Acceptable Composition (vol % of feedstock) | Sample Ti-based Feedstock (vol % of feedstock) |
|---|---|---|
| Metal Powder [e.g., Powders of reactive metals] | At least 45 | 62.1 ($TiH_2$ powder) |
| Binder (can also act as solvent) [e.g., aromatic compounds] | 15-40 | 29.3 (naphthalene) |
| Polymer [e.g., Thermoplastics and thermosets] | 0-10 | 2.1/2.3 (EVA/epoxy) |
| Surfactant [e.g., Surfonic N-100 ®] | 0-3 | 2.3 (Surfonic N-100 ®) |
| Lubricant [e.g., Organic Acids and Solid Waxes] | 0-3 | 1.5 (stearic acid) |
| Sintering Aid [e.g., Silver] | 0-1 | 0.4 (silver) |

Another aspect of the present invention is a method of forming metal articles from the feedstock described earlier. Referring to FIG. 1, one embodiment of the method comprises the steps of mixing a metal powder 101 and an aromatic species 102 to form a feedstock; and then processing the feedstock into a metal article using a powder metallurgy technique. While FIG. 1 illustrates a metal injection molding process, the present invention is not limited to only one powder metallurgy technique. Additional techniques include extrusion, compression molding, powder rolling, blow molding, and isostatic pressing, among others; all of which are contemplated in the present invention. The aromatic binder system in the feedstock utilized by the method of forming may further comprise additives 103 such as polymers, surfactants, lubricants, and sintering aids, in various combinations and concentrations consistent with the embodiments described above. The feedstock can also include alloying powders 104 that will result in metal alloy articles after processing of the feedstock.

Figure 2:
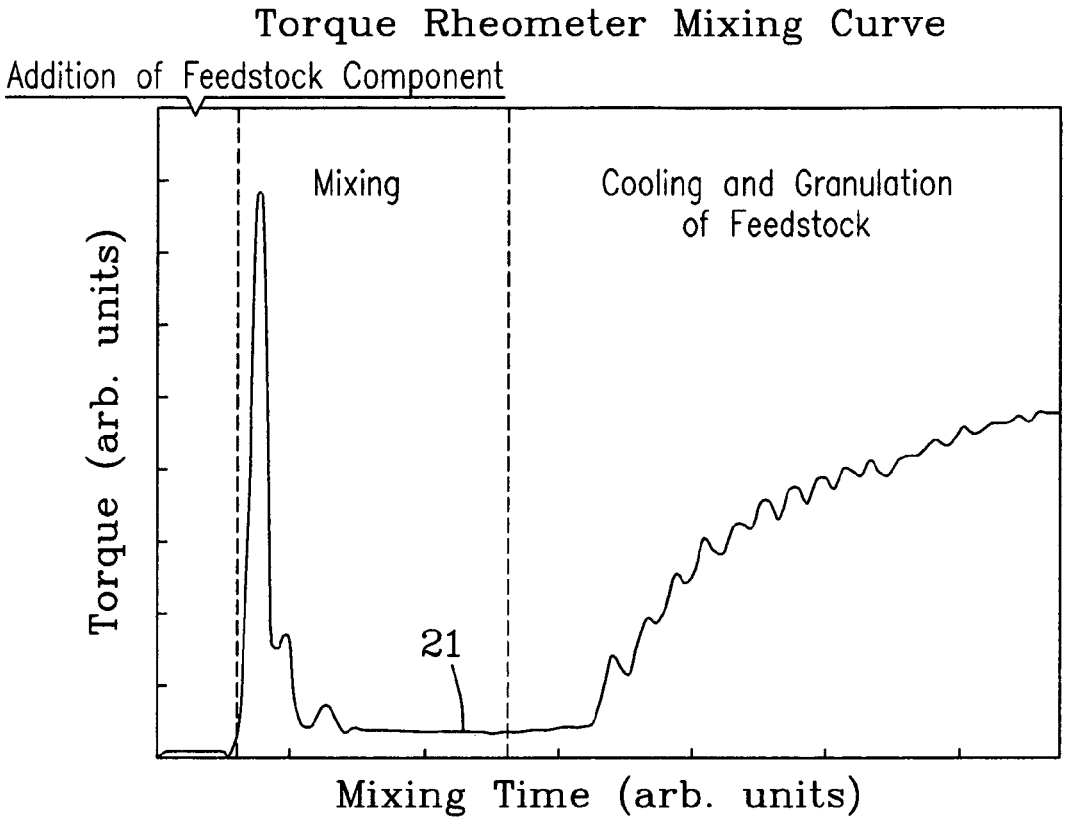
FIG. 2 is a plot of the torque applied to the mixing blades as a function of time.

Mixing of the feedstock constituents can occur at a particular temperature using a high-shear mixer 105 while measuring the torque applied to the impellers 106. The mixer should operate at a rotation speed sufficient to disperse the elements that constitute the feedstock. In one embodiment, the high-shear mixer operates at 50 RPM. Referring to the plot of the measured torque versus time in FIG. 2, the feedstock is considered well-mixed after the amount of torque required to rotate the impellers decreases and then remains constant 21 with respect to time. For a feedstock comprising naphthalene and a Ti-based powder, the typical mixing time is approximately ten minutes.

The temperature should be just above the melting temperature of the binder system to minimize premature sublimation and prevent premature solidification of the feedstock during mixing. In a preferred embodiment, where the aromatic species 102 comprises naphthalene and the metal powder 101 is Ti-based metal powder, the appropriate mixing temperature comprises approximately 85° C. One skilled in the art would recognize that the composition of the feedstock and the presence of additives, such as surfactants, lubricants, and polymers, can result in melting point depression of the aromatic binder system. In such an instance, the actual melting temperature of the binder system can be readily determined empirically by one skilled in the arts, e.g., by constructing a cooling or heating curve.

The method of forming may further comprise the steps of solidifying and pelletizing the feedstock. In one embodiment, these steps comprise decreasing the temperature of the mixer 105 to a value below the freezing temperature of the aromatic binder system while continuing to run the mixer 105. The decreased temperature causes the binder system to solidify at which point the mixer blades 106 granulate the feedstock into pellets, granules, or powders. For a feedstock comprising naphthalene and a Ti-based powder, the appropriate temperature is approximately 78° C.

The steps of mixing and pelletizing can alternatively occur using an extruder 107 and a pelletizer 109. Prior to pelletizing, a large batch mixer 105 premixes the metal powder and the aromatic binder system. The premixed powders then go through a single- or twin-screw extruder 107, which melts the aromatic binder system and disperses the metal powder evenly in the heated extruder barrel resulting in a homogeneous feedstock. The extruder then extrudes ⅛ to 3/16 inch diameter rods through an extrusion die, which solidifies upon cooling. The cooled rod 108 feeds into a pelletizer 109 that chops the rod into ⅛ to ¼ inch length pellets 110.

In another embodiment of the method, processing of the feedstock comprises the steps of injecting the feedstock into a mold 111, thereby forming a green state 112; debinding the green state, thereby forming a brown state; sintering the brown state, thereby forming a fully-dense metal article; and then cooling the resultant metal article. Metal articles formed according to the present invention have an increase in carbon and oxygen content less than or equal to approximately 0.2 wt % relative to the metal powder used to form the article. Table 2 presents experimental results comparing the carbon and oxygen content in a metal article processed according to an embodiment of the present invention with the carbon and oxygen content in the Ti-6Al,4V powder used in the feedstock to form the same article. The Ti-6Al,4V powder was a high-purity alloy containing 6 wt % aluminum and 4 wt % vanadium obtained from Titanium Systems, Inc. (Phoenix, Ariz.). Prior to processing, the powder contained 0.08 wt % carbon and 1.46 wt % oxygen. After the powder was mixed with the binder to form the feedstock and then processed, the carbon and oxygen increased by approximately 0.2 and 0.07 wt %, respectively.

TABLE 2

Summary of carbon and oxygen content present in the Ti 6Al,4V metal powder prior to MIM processing according to an embodiment of the present invention and in the resultant Ti metal article after MIM processing.

| Impurity | Ti 6,4 Metal Powder (wt %) | MIM Ti Article (wt %) |
|---|---|---|
| Carbon | 0.08 | 0.30 |
| Oxygen | 1.46 | 1.53 |

The metal article could further comprises an increase in nitrogen content less than or equal to approximately 0.2 wt % relative to the metal powder used to form the article.

According to one embodiment of the method, injection of the feedstock into the mold 111 occurs while maintaining the feedstock in the injector 113 at a temperature greater than its melting point. However, the temperature of the mold 111 should remain below the melting point of the feedstock to allow the injected part to solidify. For example, the preferred temperature for a feedstock comprising naphthalene and a Ti-based powder is greater than or equal to approximately 85° C. For the same feedstock, the mold 111 should be held below approximately 85° C., and is preferably approximately 78° C. The injection can also occur using an injector 113 with a barrel 114 held at a temperature ranging between approximately 120° C. and 140° C. The pressure within the injector 113, i.e. the injection pressure, can be between 3000 and 20,000 psi and can be generated in a number of ways including pneumatic, hydraulic, and mechanical.

After the feedstock solidifies in the mold 111 to form a green state 112, the debinding step 115 seeks to remove as much of the aromatic binder as possible. In one embodiment, the green part 112 is heated under vacuum to a temperature just below the melting point of the feedstock. A vacuum pressure of approximately 35 Torr is acceptable, but even lower pressures are preferable to aid in the sublimation of the binder. The duration of the debinding step may comprise approximately 8 to 48 hours. Alternatively, the green-state-debinding step can comprise cleaning and drying using densified fluids, for example, densified propane. Debinding using densified propane involves: i) pressurizing and heating a chamber containing the green part to transition the propane to its densified phase; ii) displacing the binder species with the densified fluid; and iii) depressurizing the chamber, which results in complete evaporation of the propane.

Figure 3:
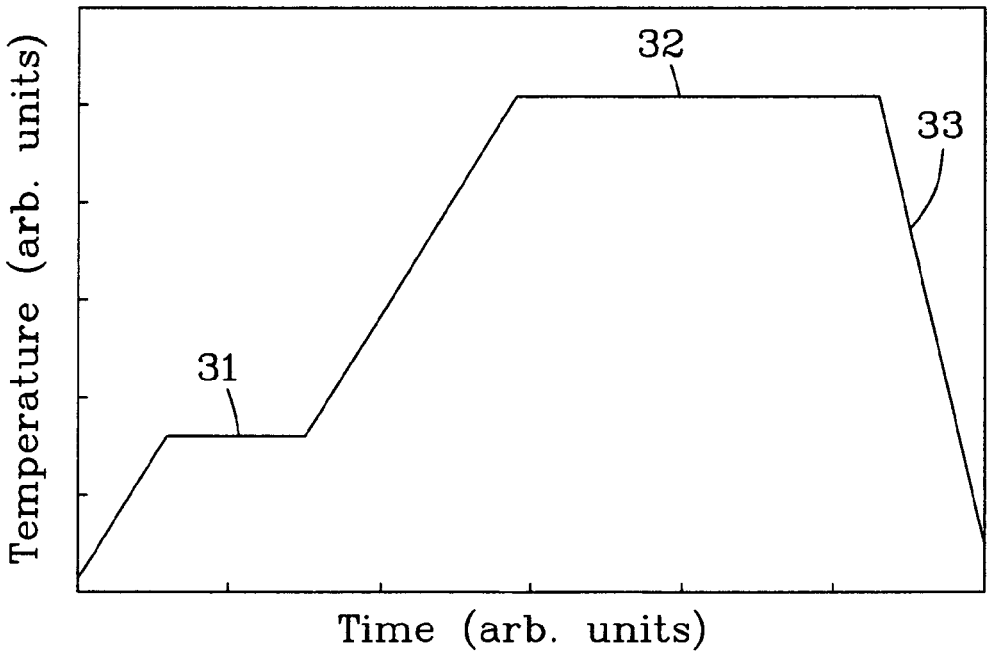
FIG. 3 is a plot of the temperature during sintering as a function of time.

The brown state is the result of debinding the green state and requires a sintering step 116 to form a coherent mass. Referring to the plot of sintering temperature versus time in FIG. 3, the sintering step can comprise ramping the temperature to a first set point 31 and maintaining that temperature for a particular duration. After the first heating stage 31, ramping of the temperature continues to a second set point 32, where heating persists for another period of time. The first set point 31 is approximately 300° C. to 600° C. The first period of heating 31 may be approximately 60 to 180 minutes. The second period of heating 32 may range from 1000° C. to 1350° C. and may last between one and six hours. In a preferred embodiment, the second heating stage has a duration of approximately 4 hours at 1100° C. The ramp rate in both cases may range from 1 to 20° C. per minute. Cooling 33 of the part finalizes the sintering step, and can comprise using a furnace chiller to decrease the temperature as rapidly as possible.

As in the debinding step 115, the sintering step 116 involves heating the brown state in the absence of impurities, particularly oxygen, carbon, and nitrogen, to retain the desired material properties of the pure metal or alloy. Therefore, the sintering step 116 can comprise heating the metal part in a hydrogen cover gas. Alternatively, the heating may occur under high vacuum, at or below approximately $1\times10^{-5}$ Torr. Sintering can also comprise a sequential combination of heating in various atmospheres including a hydrogen cover gas and under high vacuum.

The present invention also encompasses a metal-injection-molded article processed in accordance with the method-of-forming embodiments described above. The instant article has an increase in carbon and oxygen content each less than or equal to approximately 0.2% relative to the metal powder used to process the article. The same article can further comprise an increase in nitrogen content less than or equal to approximately 0.2% relative to the metal powder used to process the article.

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. A composition comprising a reactive metal powder, a polymer, and an aromatic binder, wherein said reactive metal powder comprises a metal alloy and said polymer is ethylene vinyl acetate (EVA), polyethylene, or both; and wherein said aromatic binder and said reactive metal powder are mixed to form a feedstock for powder metallurgy forming techniques, said feedstock comprising less than approximately 40 vol % of said aromatic binder and up to 10 vol % of said polymer.

2. The composition as recited in claim 1, wherein said powder metallurgy forming techniques are selected from the group consisting of injection molding, extrusion, compression molding, powder rolling, blow molding, laser forming, isostatic pressing, spray forming, and combinations thereof.

3. The composition as recited in claim 1, wherein said aromatic binder comprises a polycyclic aromatic.

4. The composition as recited in claim 3, wherein said polycyclic aromatic is selected from the group consisting of naphthalene, anthracene, pyrene, phenanthrenequinone, and combinations thereof.

5. The composition as recited in claim 1, wherein said aromatic binder comprises benzene and naphthalene.

6. The composition as recited in claim 1, wherein said aromatic binder comprises approximately 29% to 37% by volume of said feedstock.

7. The composition as recited in claim 1, wherein said metal alloy comprises Ti-6Al,4V.

8. The composition as recited in claim 1, wherein said metal powder comprises at least 45% by volume of said feedstock.

9. The composition as recited in claim 1, wherein said reactive metal powder comprises approximately 45% to 95% by volume of said feedstock.

10. The composition as recited in claim 1, wherein said reactive metal powder comprises approximately 54.6% to 70% by volume of said feedstock.

11. The composition as recited in claim 1, wherein said feedstock further comprises a surfactant.

12. The composition as recited in claim 11, wherein said surfactant comprises a nonionic surfactant.

13. The composition as recited in claim 1, wherein said feedstock further comprises a lubricant.

14. The composition as recited in claim 13, wherein said lubricant is selected from the group consisting of organic fatty acids, metallic salts, solid waxes and combinations thereof.

15. The composition as recited in claim 14, wherein said organic fatty acid is selected from the group consisting of stearic acid, branched versions of stearic acid, substituted versions of stearic acid, and combinations thereof.

16. The composition as recited in claim 14, wherein said metallic salts are selected from the group consisting of sodium stearate, calcium stearate, and combinations thereof.

17. The composition as recited in claim 14, wherein said solid waxes are selected from the group consisting of microcrystalline waxes, paraffin waxes, carnuba wax, and combinations thereof.

18. The composition as recited in claim 13, wherein said lubricant comprises up to approximately 3% of the volume of said feedstock.

19. The composition as recited in claim 13, wherein said lubricant comprises approximately 1.5% of the volume of said feedstock.

20. The composition as recited in claim 1, further comprising an additional metal powder that comprises an alloying powder.

21. A composition for forming articles by powder metallurgy forming techniques, said composition comprising a metal powder, a polymer, and an aromatic binder, wherein said metal powder comprises a metal alloy, said polymer is ethylene vinyl acetate (EVA), polyethylene, or both, and said aromatic binder is benzene, naphthalene, anthracene, pyrene, phenanthrenequinone, or a combination thereof; and wherein said aromatic binder and said metal powder are mixed to form a feedstock for powder metallurgy forming techniques, said feedstock comprising 29 vol % to 37 vol % of said aromatic binder, at least 45 vol % of said metal powder, and up to 10 vol % of the polymer.

* * * * *